United States Patent [19]

Jones

[11] Patent Number: 4,993,344

[45] Date of Patent: Feb. 19, 1991

[54] TORPEDO DEFENSE FOR SHIPS

[75] Inventor: Louis F. Jones, Panama City, Fla.

[73] Assignee: The United States of America, as represented by the Secretary of the Navy, Washington, D.C.

[21] Appl. No.: 515,715

[22] Filed: Dec. 22, 1965

[51] Int. Cl.[5] ..... B63G 9/00

[52] U.S. Cl. ..... 114/240 R; 89/1.11

[58] Field of Search ..... 89/1, 117; 114/240, 114/238, 239

[56] References Cited

U.S. PATENT DOCUMENTS

| | | | |
|---|---|---|---|
| 2,365,066 | 12/1944 | Fuller | 114/240 R |
| 2,386,950 | 10/1945 | Hopkins | 114/240 R |
| 2,388,589 | 11/1945 | Woodling | 114/240 R |
| 2,404,440 | 7/1946 | Holm | 114/240 R |
| 2,971,490 | 2/1961 | McKinney et al. | 114/240 R |
| 2,979,015 | 4/1961 | Estes | 114/240 R |
| 2,991,742 | 7/1961 | Steinberg | 114/23 |

*Primary Examiner*—David H. Brown

*Attorney, Agent, or Firm*—Sol Sheinbein; John Becker; Harvey David

[57] ABSTRACT

A method and means for protecting ships from torpedo attack having an explosive weapon which may be launched overboard as soon as feasible after the detection of said attacking torpedo. The aforesaid weapon contains explosive means as well as steering, depth, and speed control means that are regulated by programmed controls, respectively, which are set prior to the launching of the weapon and thereby cause it to traverse and maintain a probable collision course with said torpedo.

3 Claims, 3 Drawings

INVENTOR
LOUIS FRANKLIN JONES

TORPEDO DEFENSE FOR SHIPS

The invention described herein may be manufactured and used by or for the Government of the United States of America for governmental purposes without the payment of any royalties thereon or therefor.

The present invention relates to the protection of ships from torpedo attack and particularly to a ship launched automobile explosive barrier type weapon for destroying or disabling a torpedo as it approaches the vicinity of the ship on a probable collision course and its method of use.

Probably the most effective system heretofore employed in war for the protection of a moving ship against torpedo attack was the one in which ship length explosive streamers were towed through the water by a ship at a predetermined distance from the ship, the streamers having arranged therein means for detecting the approach of a torpedo and detonating the explosive to destroy or disable the torpedo moving within the vicinity of the streamer. Examples of such towing arrangements are shown in U.S. Pat. Nos. 2,404,440, Holm, 2,941,493, Glennon et al and 2,668,512, Klas, and a special streamer is disclosed in U.S. Pat. No. 2,971,490 to McKinney et al. Such streamer barriers continuously deployed not only slowed down the towing ship but greatly reduced its ability to maneuver for taking evasive action when under attack.

Other anti-torpedo concepts include the firing of individual missiles and the launching of guided or homing devices for intercepting and destroying an approaching torpedo. Such concepts involve the difficulty of ranging and tracking each torpedo with a fair degree of accuracy as it approaches.

An object of the present invention is to provide a self-propelled explosive barrier for destroying a torpedo coming within the lethal range of the barrier.

Another object of the invention is to provide a ship with protection against torpedo attack which requires only knowledge of the bearing of a torpedo approaching on a probable collision course.

A further object of the invention is to provide an automobile torpedo barrier which can be programmed to provide protection in coordination with the speed of the ship being protected as well as with the maneuver the ship's captain decides to make.

A still further object of the invention is to provide an untethered, unfettered, self-propelled barrier to be launched from above deck and with its explosive streamer so stowed that it can be pulled out at high speed with minimum tension.

Other objects and advantages of the invention will become evident from the following description when read in connection with the accompanying drawings in which.

In accordance with the preferred embodiment of the invention the self-propelled barrier consists of a line charge in the form of an explosive streamer towed by a tractor vehicle such as a torpedo-like tug having course and speed changes programmed just prior to launching from an individual non-trainable launcher comprising a firing tube which houses the tug and is preferably powered by compressed air, and an adjacent canister in which the explosive streamer is prepacked in a unique coiled configuration so that it can be pulled out without tension surges at the high speed of launching of the tug to which it is attached.

Figure 1:
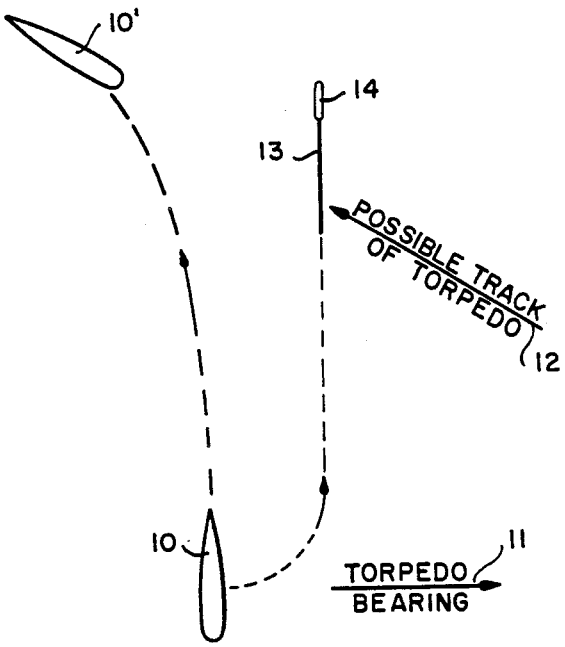
FIGS. 1 and 2 illustrate, respectively, two different tactical situations utilizing the invention.
Figure 2:
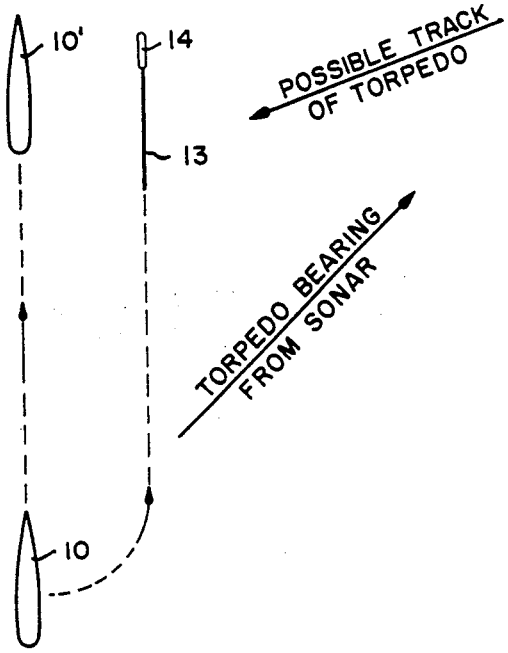

Referring now to the drawings, wherein like reference characters designate like parts throughout the several views, FIGS. 1 and 2 respectively show two different tactical situations which a defending ship 10 may take against an approaching marine vehicle, such as, for example, a torpedo whose bearing but not necessarily range has been detected by the ship's passive sonar or other means and classified as a torpedo. FIG. 1 illustrates a situation when a torpedo is first detected on a relative bearing of approximately 90° as indicated by the arrow 11. A short time later, one or more bearing readings may have been taken which indicate a possible torpedo track indicated by the arrow 12 on a collision course with the ship 10. The ship's captain, from the information provided by the sonar and probably with the aid of the ship's computer, decides what maneuver to make, which maneuver generally is either (1) turn away from the torpedo to "comb the track" or on some other course, and/or (2) accelerate or decelerate. In the situation illustrated in FIG. 1, an evasion maneuver has been decided upon and the tug or propulsion vehicle 14 for the barrier is programmed and launched so as to place it generally athwart any torpedo track 12 which would intersect the future position of the ship at 10' at which time an explosive streamer 13 towed by its tug 14 is in the position illustrated and moving at a relatively slow speed as programmed. In either case, the tug 14 is launched at high speed, e.g., 50 knots, with its gyro set to make a 90° turn to port (or starboard) and after it has come to the position of shielding the ship 10 from the torpedo, its speed is reduced as required to maintain it in its desired barrier position. In its position illustrated in FIG. 1, the tug 14 would probably be traveling at an idling speed of say 2 to 3 knots, and thus the streamer 13 remains for a period of time between the ship 10 and a torpedo approaching along the track 12.

In the situation illustrated in FIG. 2, a torpedo has been detected on a relative bearing of approximately 45°, the ship's captain decides to continue straight ahead and the tug 14 is programmed to follow a track parallel to the ship's course at speeds such that the line charge comprising the streamer 13 assumes and continues in a position parallel to future positions of the ship 10' and substantially athwart the possible track of the detected torpedo. In this particular situation, the tug 14 is programmed for a 90° turn to port, an initial high speed to bring it abreast the ship 10 and thereafter to proceed at the speed of the ship, say 25 knots, for the period of time during which any threat from the detected torpedo persists. When a salvo of torpedoes is detected or when the line charge 13 is shorter than the length of the ship to be protected, as will probably be the case for aircraft carriers, two or more tug-streamer devices are launched in echelon fashion with an overlap suitable for the prevailing situation.

Figure 3:
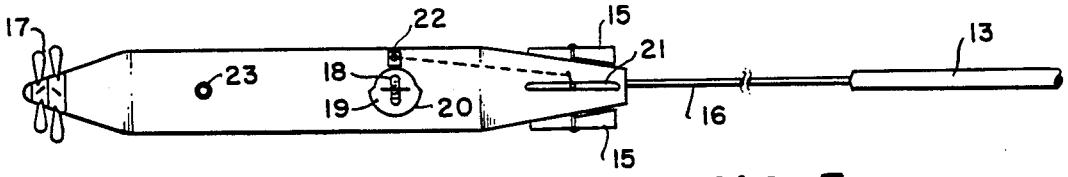
FIG. 3 is a plan view of a self-propelled barrier with a portion of its explosive streamer broken away.

FIG. 3 is a plan view showing the tug 14 and its explosive streamer 13 running on a desired course. The explosive streamer 13 in connected to the tug 14 through a pendant 16 comprising a strain and conductor cable which is somewhat longer than the tug 14 in order to facilitate packaging in the launcher device shown in FIG. 6. The tug 14 preferably has a shape and size similar to a torpedo and has it propellers 17 located on the forward end to avoid having the pendant 16 enter the tug 14 through the propeller shaft. The tug 14 is provided with elevator vanes 15 and a gyro 18 having a cam plate 19 and cam pawls 20 for controlling steering rudders 21 through the operation of a steering engine 22 as is well known. The tug 14 may also be provided with a water soluble plug 23 for flooding and sinking the tug 14 after a selected time interval. Other elements of the control system for the tug 14 are described in connection with FIG. 5.

Figure 4:
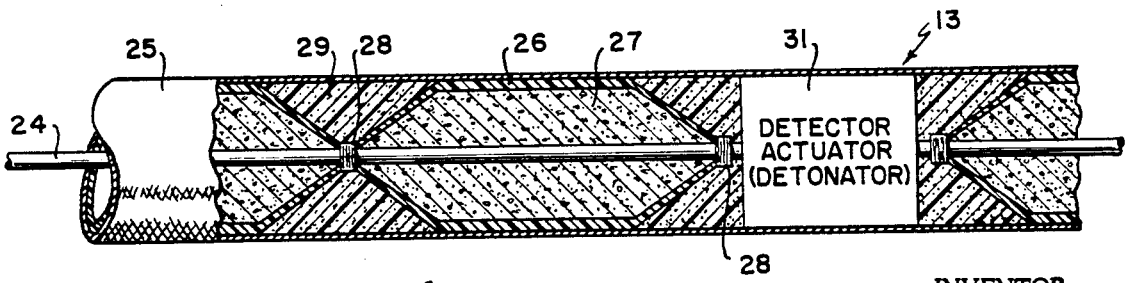
FIG. 4 is a partial sectional view of a fragmentary portion of the explosive streamer.

A section of the streamer 13 is shown in FIG. 4 as comprising an axial core 24 of primacord and electrical conductors and an outer hose 25 which preferably may be made of strong synthetic fiber woven material for carrying the towing tension and presenting a smooth outer surface to the stream. A watertight inner hose 26 of, say, extruded plastic is packaged with flake or granular explosive 27 and is necked down to the core 24 at intervals of about eight inches by clamp ties or twine 28 to allow a small bending radius. The voids between the outer and inner hoses 25 and 26, respectively, at these necked down sections are filled with sponge rubber 29 or other suitable flexible flotation material to provide the desired overall neutral buoyancy for the streamer 13. At suitably spaced intervals, say about thirty feet, along the streamer 13, detector actuators 31 are housed within the hose 25 to function as proximity fuzes to detonate all or an adjacent aft portion of the streamer 13 upon the approach of a torpedo. The detector actuators 31 may include a microphone, a rate-of-rise sensitive amplifier and an anti-counter-mine device for preventing actuation by the detonation of a neighboring streamer all in a well known manner.

Figure 5:
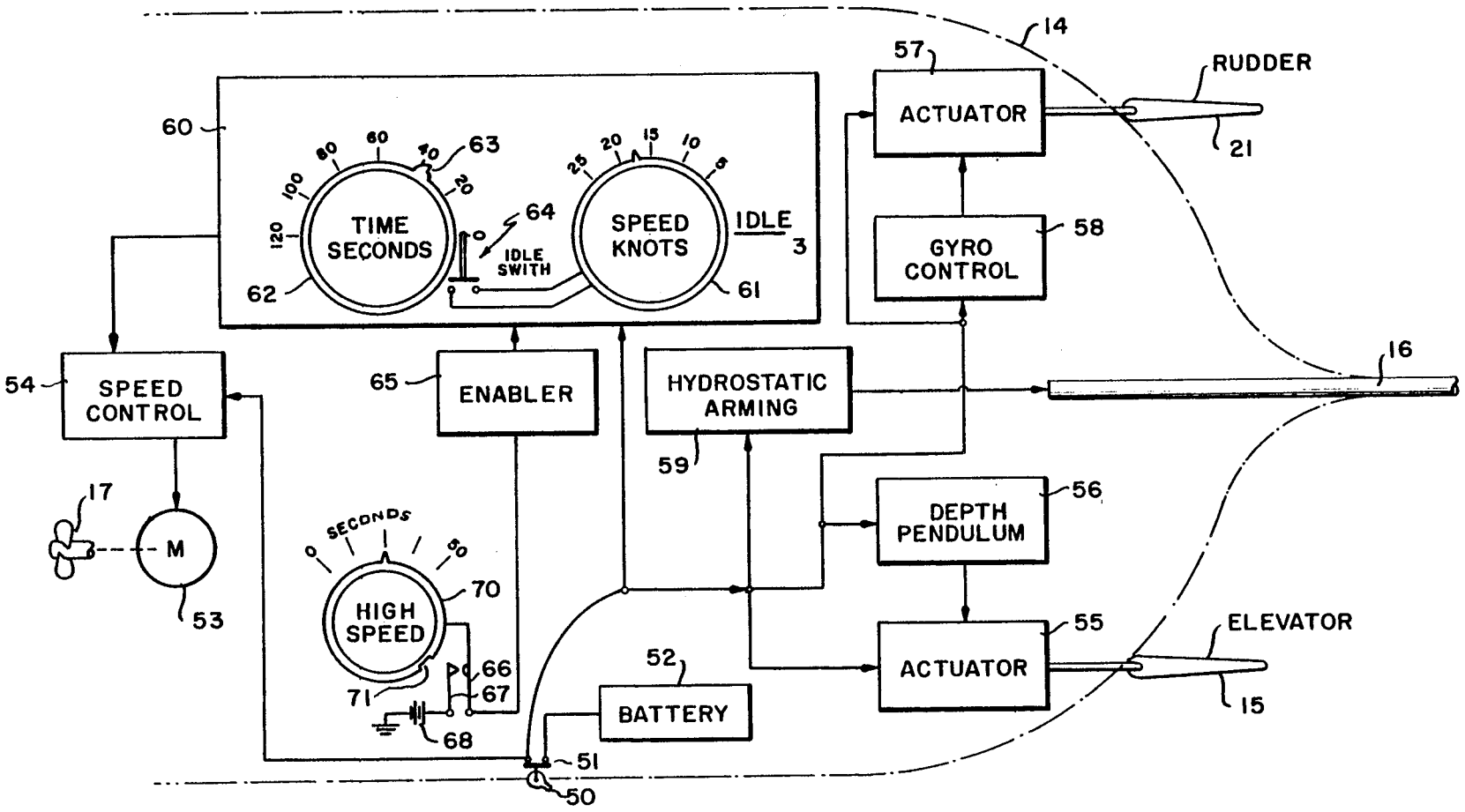
FIG. 5 shows diagrammatically a control system for a self-propelled tug suitable for towing the explosive streamer.

Referring now to FIG. 5, there is shown diagrammatically a representation of the control system for the tug 14, including conventional features well known to the torpedo art. As here shown, a starting lever 50 mounted to extend outside the wall of the tug 14 is thrown aft (as shown) as it leaves the launching tube, hereinafter described, thereby closing a switch 51 to connect a battery 52 to a drive motor 53 for the propeller 17 through a speed control device 54 which unless otherwise controlled, operates at high, i.e., full, speed. The closing of the switch 51 also connects the battery 52 to an actuator 55 which deflects the elevator fins 15 under the control of a depth and pendulum unit 56 for causing the tug 14 to travel at a preselected depth. In a similar manner, an actuator 57 deflects the rudders 21 in response to a gyro control unit 58 the gyro wheel of which as in conventional torpedoes is initially brought up to speed and then continues to spin of its own momentum. A hydrostatic arming unit 59 powered through the switch 51 arms the explosive streamer 13 when the tug 14 reaches a certain depth which preferably is substantially less than the running depth as determined by the depth and pendulum unit 56. For reducing the speed of the tug 14 for a selected time interval, a control unit 60 is provided with a speed selecting knob 61 and a timer knob 62 which rotates with its timing mechanism from a selected time setting to zero time where a cam 63 carried by the knob 62 closes an idle switch 64 which returns the speed knob 61 to idle position which may correspond to a speed of 2 or 3 knots for maintaining stability in the tug 14 and its streamer 13. The control unit 60 does not influence the speed control device 54 until an enabler 65 is actuated by the closure of contact springs 66 and 67 to apply a potential from a battery 68 to the enabler 65. A settable timing device having a rotary cam 70 serves to hold the contact springs 66 and 67 open until an open portion 71 of the cam 70 moves into alinement with the contact spring 66 thereby permitting the spring 66 to close the contacts and terminate the high speed run of the tug 14.

Figure 6:
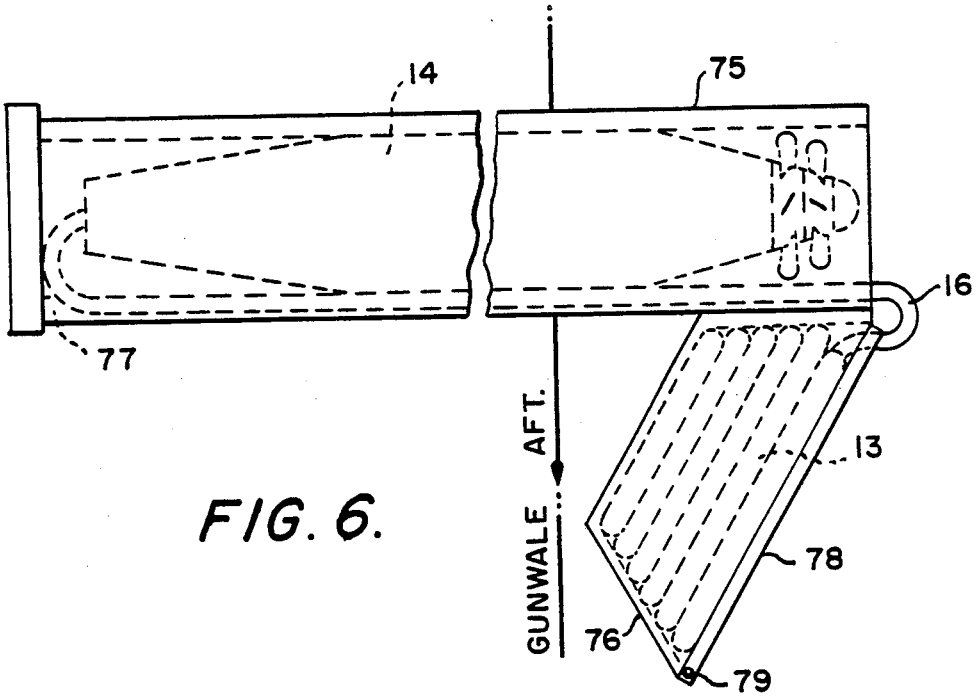
FIGS. 6 and 7 are conventionalized showings of side and end views, respectively, of a launcher for the barrier of the invention.
Figure 7:
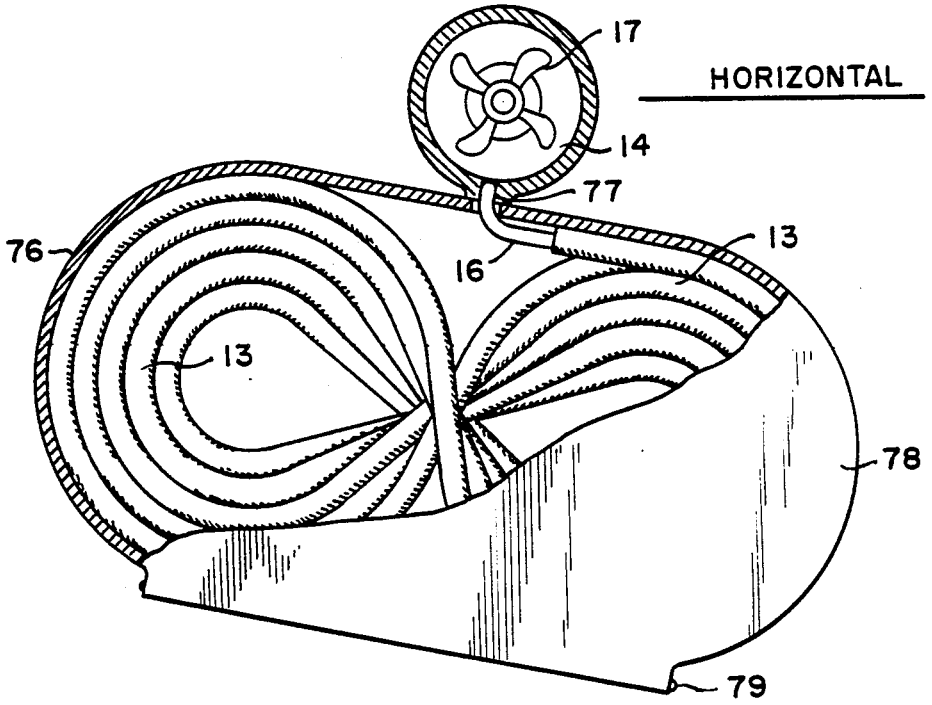

FIGS. 6 and 7 are conventionally showings of side and end views, respectively, of a launcher for the explosive barrier of the invention. As here shown, the launcher consists of a launching tube 75 for the tug 14 and a canister 76 in which the line charge 13 is faked, preferably in the form of a FIG. 8 so that it may be pulled out without tension surges and a minimum amount of twist thereby eliminating any kinking tendency. The launching tube 75 may be an ordinary non-submerged torpedo tube powered by compressed air and modified to provide a groove or channel 77 running the length of the tube 75 and along the inner bottom thereof for receiving the pendant 16 which extends from the rear of the tug 14 along the groove 77 and extends beyond the front of the tube 75 where it is curved downwardly and secured to the line charge 13. The canister 76 may be provided with a lid 78 swingably mounted along its lower edge to the canister 76 by a hinge 79 so that upon launching of the tug 14, the lid 78 is swung open by the movement of the pendant 16 and the line charge 13 to permit free uncoiling thereof. As in the case of ordinary torpedoes, this launcher provides the tug 14 a muzzle velocity which is sufficient when combined with the fast-start capability of the tug 14 as it enters the water a hundred feet or so from the ship to carry the line charge 13 away from the ship within a few seconds. Inasmuch as the ship carrying the launch tube 75 will be moving forward at the time the tug 14 is launched at right angles to the gunwale of the ship, it is desirable that the canister 76 be directed at such an angle downwardly and aft of the axis of the tube 75 so that the direction the line charge is withdrawn from the canister 76 is more or less perpendicular to the coil of the line charge as originally packaged in the canister.

While other arrangements may be utilized, it is preferred to employ non-trainable firing tubes for launching the torpedo barriers because it simplifies the programming of the tug to correspond to the ship's maneuver which must necessarily be determined as soon as possible after the detection of an attacking torpedo and any undue delay in launching the tug might be hazardous.

The system illustrated has been described above with particular reference to a preferred embodiment and two examples of its intended use. It will be understood, of course, that the invention may be embodied in systems for the protection of submerged submarines.

From the foregoing it will be evident to those skilled in the art that many modifications may be made in practicing the invention the scope of which is pointed out in the appended claims.

What is claimed is:

1. A torpedo defense system for ships comprising in combination:

a guidable, unfettered, self-propelled, tractor vehicle capable of independently traveling a predetermined underwater course;

an elongated explosive streamer;

cable means, including strain and electrical conductor cables, connected between said guidable, unfettered, self-propelled, tractor vehicle and said elongated explosive streamer for the towing thereof thereby;

means disposed entirely within and on said guidable, unfettered, self-propelled, tractor vehicle for effecting the guidance thereof along said underwater course and at depths and speeds in accordance with a program set therein immediately prior to the launching thereof, with said underwater course, depths, and speeds being such as would probably cause the aforesaid attacking torpedo to timely intercept said elongated explosive streamer and be disabled thereby at a predetermined safe distance from said ship; means disposed in said guidable, unfettered, self-propelled, tractor vehicle and connected to said elongated explosive streamer for the arming thereof when said guidable unfettered, self-propelled, tractor vehicle reaches a predetermined depth, as it travels along its preprogrammed underwater course; and means effectively mounted on a gunwale of said ship to be protected for the timely launching of the aforesaid interconnected guidable, unfettered, self-propelled, tractor vehicle and elongated explosive streamer into the water after an attacking torpedo is detected and immediately after the aforesaid vehicle guidance means has been manually programmed to guide said guidable, unfettered, self-propelled, tractor vehicle in such manner along its underwater course as to effect interception of said elongated explosive streamer by said torpedo.

2. The system of claim 4 wherein said elongated explosive streamer comprises:

an axial core containing primacord and electrical conductors;

an outer hose spatially disposed around and along said axial core;

a watertight inner hose disposed within said outer hose around and along said axial core;

means wrapped around said watertight inner hose at intermittent positions along said axial core for effectively connecting waid watertight inner hose thereto, thereby forming a first plurality of chambers therealong between the inside of said inner hose and the outer surface of said axial core, and also thereby forming a second plurality of chambers intermittently disposed therealong between the inside of said outer hose and the outside of said watertight inner hose;

an explosive charge disposed in each of said first plurality of chambers; and sponge rubber means disposed in each of said second chambers.

3. The invention according to claim 4 further characterized by a proximity fuze disposed within said elongated explosive streamer for the detonation thereof when said attacking torpedo reaches a predetermined distance therefrom.

* * * * *